US005710801A

United States Patent [19]

Dillen et al.

[11] Patent Number: 5,710,801

[45] Date of Patent: Jan. 20, 1998

[54] X-RAY EXAMINATION APPARATUS COMPRISING AN EXPOSURE-CONTROL SYSTEM

[75] Inventors: Bartholomeus G. M. H. Dillen; Rudolph M. Snoeren, both of Eindhoven, Netherlands

[73] Assignee: U.S. Philips Corporation, New York, N.Y.

[21] Appl. No.: 728,116

[22] Filed: Oct. 9, 1996

[30] Foreign Application Priority Data

Oct. 10, 1995 [EP] European Pat. Off. ..... 95202719

[51] Int. Cl.[6] ..... H05G 1/00

[52] U.S. Cl. ..... 378/98.7; 378/98.3

[58] Field of Search ..... 378/98.2, 98.7, 378/98.8, 108, 109, 110, 111, 112

[56] References Cited

U.S. PATENT DOCUMENTS

| | | | |
|---|---|---|---|
| 4,991,102 | 2/1991 | Nishiki | 378/98.8 |
| 5,101,421 | 3/1992 | Nishiki | 378/98.8 |
| 5,164,583 | 11/1992 | Aichinger et al. | 378/98.7 X |
| 5,187,730 | 2/1993 | Fujihara | 378/98.7 X |
| 5,436,952 | 7/1995 | Haendle et al. | 378/98.8 X |
| 5,461,658 | 10/1995 | Joosten | 378/98.7 |
| 5,530,935 | 6/1996 | Dillen | 378/98.2 |

*Primary Examiner*—David P. Porta
*Attorney, Agent, or Firm*—Jack D. Slobod

[57] ABSTRACT

An X-ray examination apparatus (1) includes an X-ray source (2) and an X-ray image intensifier (5) for deriving an optical image from an X-ray image, which optical image is picked up by means of an image pick-up apparatus (6). The X-ray examination apparatus also includes an exposure-control system (7) for adjusting the X-ray source and/or the image pick-up apparatus on the basis of brightness values of a region of interest in the optical image. The exposure-control system includes a photodetector, for example a CCD sensor, for deriving a photodetector signal from the optical image and a photosensor for adjusting the sensitivity of the photodetector. The photodetector (9) includes an image pick-up section (11), an image memory (13) comprising separate sections, preferably including an intermediate memory (15). An electronic image in the image pick-up section is quickly transferred to an available storage section after which it is read out as an electronic image signal. For example, the electronic image is first transferred to the intermediate memory wherefrom it is quickly transferred to the image memory after which it is read out as an electronic image signal.

20 Claims, 3 Drawing Sheets

X-RAY EXAMINATION APPARATUS COMPRISING AN EXPOSURE-CONTROL SYSTEM

BACKGROUND OF THE INVENTION

1. Field of the Invention

The invention relates to an X-ray examination apparatus, comprising an X-ray detector for convening an X-ray image into an optical image and an exposure-control system comprising a photodetector for measuring brightness values of the optical image, which photodetector comprises an image pick-up section.

2. Description of the Related Art

An X-ray examination apparatus of this kind is known from European patent Application EP 0 629 105, which corresponds to U.S. Pat. No. 5,461,658.

The known X-ray examination apparatus comprises an exposure-control system in which the photodetector is a CCD sensor and in which a photodiode is used as the photosensor. The exposure-control system comprises an adjusting unit for deriving a voltage-frequency (V/f) signal from the photosensor signal. The signal level of the photosensor signal governs the frequency of the voltage-frequency signal. Since the photosensor signal represents the mean brightness in the optical image, the frequency of the V/f signal represents the mean brightness of the optical image. The V/f signal is applied to a clock unit which adjusts the integration time of the photodetector on the basis of the frequency of the V/f signal. The adjusting unit thus adjusts the sensitivity of the CCD sensor on the basis of the mean brightness in the optical image. The brightness of the optical image is controlled on the basis of the photodetector signal which contains image information of a region of interest (ROI) in the optical image, for example by adjustment of the X-ray source, or the signal level of the electronic image signal is controlled by adjustment of the gain of the image pick-up apparatus or of the aperture of a diaphragm of the image pick-up apparatus.

As the brightness of the optical image is higher, the frequency of the V/f signal is higher, thus reducing he integration time of the photodetector. If the integration time becomes shorter than the time required for reading out the CCD sensor, the integration of an image by the photodetector of the exposure-control system is stopped if the preceding image has not yet been read from the image memory of the CCD sensor. It is a drawback of the known X-ray examination apparatus that in that case the image just integrated cannot be transferred to the image memory; it is then necessary to pick up an image again which, after the image memory has been vacated, is transferred to the image memory and subsequently read out. It is notably if an image integration is stopped just before the image memory has been vacated that the known X-ray apparatus requires a comparatively long period of time, i.e. almost twice the read-out time, for adapting the control signal to a change in the optical image, for example a brightness increase.

SUMMARY OF THE INVENTION

It is an object of the invention to provide an X-ray examination apparatus which includes an exposure-control system which is capable of adapting the control signal very quickly to a change in the optical image.

This object is achieved by means of an X-ray examination apparatus in accordance with the invention which is characterized in that the image storage section includes in a first storage section and a second storage section and is arranged to receive brightness values in the first storage section while brightness values are being read from the second storage section.

The X-ray examination apparatus includes an image pick-up apparatus for deriving an image signal from the optical image. The image signal is, for example an electronic video signal whose signal levels represent brightness values of the optical image. The exposure control system ensures that the X-ray apparatus is adjusted so that an X-ray image of high diagnostic quality is formed and reproduced, i.e. that small details are included in the X-ray image and reproduced in a suitably visible manner. To this end, the exposure control system ensures that the signal level of the image signal is situated in a suitable interval. The exposure control system derives a control signal from the photodetector signal. This control signal is used to control the intensity and/or the energy of the X-ray beam. The control signal is also suitable for controlling the signal level of the image signal directly or indirectly.

The image pick-up section includes a plurality of photosensitive elements and the image storage section includes a plurality of image storage elements. Individual photosensitive elements convert incident light into electrical charges which represent brightness values of the optical image. The optical image is picked up by the image pick-up section during successive, brief time intervals so that successive brightness values of successive images are picked up. The electrical charges are stored in the image storage elements. The sensitivity of the photodetector is controlled on the basis of the mean brightness of the optical image. To this end, a photosensor is used to derive a photosensor signal from the optical image. This photosensor signal represents the mean brightness of the optical image and the sensitivity of the photodetector is controlled by means of the photosensor signal. The photodetector signal is formed by reading the brightness values of the first image from the first storage section. If the sensitivity of the photodetector has been adjusted to a low value, the image pick-up section will require a very short period of time for picking up an image. As the period of time required for picking up an image is shorter, it will be more likely that the picking up of a next image in the image pick-up section will have been completed before completion of the reading out of the first image. In that situation the next image is stored as a second image in the second storage section. It is thus achieved that the photodetector signal corresponding to the next image becomes available without it being necessary to pick up an image again after the preceding electronic image has been read. The X-ray examination apparatus in accordance with the invention thus enables reading of images from the photosensor in rapid succession and adaptation of the control signal on the basis of these images.

A preferred embodiment of an X-ray examination apparatus in accordance with the invention is characterized in that the first storage section constitutes an image memory, and that the second storage section is constructed as an intermediate memory which is coupled to the image pick-up section and to the image memory.

The intermediate memory is a storage section which is situated between the image pick-up section and the remainder of the image memory. The electronic image is transferred from the image pick-up section to the intermediate memory and, as soon as the image memory has been vacated, the electronic image is transferred from the intermediate memory to the image memory. Transferring an electronic image from the image pick-up section to the intermediate memory and from the intermediate memory to the image memory requires far less time than the reading out of the photodetector signal. As soon as an electronic image has been read out from the image memory as a photodetector signal, the electronic image in the intermediate memory can be quickly transferred to the image memory, so that the intermediate memory becomes quickly available again to receive a new electronic image from the image pick-up section. Consequently, within a very short period of time (in comparison with the read-out time) after an electronic image has been read out, the reading out may commence of the next electronic image which has meanwhile been transferred to the vacated image memory.

A further preferred embodiment of an X-ray examination apparatus in accordance with the invention is characterized in that the image pick-up section is charge-coupled to the intermediate memory and/or that the image pick-up section is charge-coupled to the intermediate memory.

Charge-coupled transfer of an electronic image from the image pick-up section to the intermediate memory and further to the image memory takes place within a very short period of time. As a result, adaptation of the control signal to a change in the optical image will not require more time than substantially the read-out time of the photodetector.

A further preferred embodiment of an X-ray examination apparatus in accordance with the invention is characterized in that the intermediate memory forms part of the image pick-up section.

In this embodiment it suffices to transport the electronic image in the image pick-up section by charge-coupled transfer within the image pick-up section, so that a particularly short period of time is required for storing the electronic image in the intermediate memory. Provided that the electronic image is sufficiently smaller than the capacity of the image pick-up section, i.e. smaller than the largest image that can be accommodated in its entirety in the image pick-up section, no image information need be lost when a part of the image pick-up section is used as an intermediate memory.

A further preferred embodiment of an X-ray examination apparatus in accordance with the invention is characterized in that the exposure-control system includes an optical system for imaging at least a part of the optical image on no more than a part of the image pick-up section.

The optical system ensures that only a part of the image pick-up section is exposed. The part of the image pick-up section which is not exposed remains available as an intermediate memory. It is to be noted that from Japanese Patent Application JP 63-48 974 it is known per se to expose only a part of the image pick-up section.

A further embodiment of an X-ray examination apparatus in accordance with the invention is characterized in that the optical system comprises a gradient index (GRIN) lens.

A gradient index (GRIN) lens is a rod-shaped lens having a radially varying refractive index. Such a GRIN lens has a length of approximately one half centimeter and a diameter of from approximately 1 to 2 min. Because a GRIN lens is so small, it occupies very little space. As a result, the use of such a GRIN lens contributes to compactness of the construction of the exposure-control system. Furthermore, a GRIN lens of suitable length has a particularly short focal distance of approximately 1 mm and a high numerical aperture. Consequently, the GRIN lens can be arranged very near to the photosensitive surface of the photodetector and nevertheless sharply image the optical image on a part of the image pick-up section, the remainder of the image pick-up section not being exposed. This counteracts the disturbing of an electronic image stored in the intermediate image during exposure of the image pick-up section. The use of the GRIN lens allows for a compact construction of the exposure-control system. It is to be noted, however, that from Japanese Patent Application JP 4-188 872 it is known per se to expose a single photosensitive element of the image pick-up section by means of an optical fibre.

A further preferred embodiment of an X-ray examination apparatus in accordance with the invention is characterized in that the exposure-control system is arranged to apply the control signal to the X-ray source or to the high-voltage power supply of the X-ray source.

The control signal is used to adjust the energy and the intensity of the X-rays on the basis of brightness values in the optical image. This avoids overexposure or underexposure of regions of interest in the optical image. The electronic image signal derived from said optical image is used to display the image information with a high diagnostic quality, i.e. in such a manner that small details are suitably visible.

A further preferred embodiment of an X-ray examination apparatus in accordance with the invention is characterized in that the exposure-control system is arranged to apply the control signal to a control unit or to a diaphragm of the image pick-up apparatus.

If the image pick-up apparatus is adjusted by means of the control signal on the basis of image information in the optical image, the image pick-up apparatus supplies an electronic image signal enabling the display of the image information with a high diagnostic quality. The control signal notably adjusts the diaphragm aperture or the gain of the image pick-up apparatus in conformity with the mean brightness and/or the dynamic range in regions of interest in the optical image. In the case of an appropriate gain and/or diaphragm aperture, the image pick-up apparatus supplies an electronic image signal whereby the image information in a corresponding region of interest in the X-ray image is displayed with a high diagnostic quality.

It is a further object of the invention to provide an X-ray examination apparatus enabling faster acquisition of image signals from successive X-ray images than in a conventional X-ray examination apparatus, without introducing disturbances in said image signals. This object is achieved by means of an X-ray examination apparatus including first and second image storage sections which are arranged such that image brightness values are received in the first image storage section while image brightness values are being read from the second image storage section. Using such an X-ray examination apparatus in accordance with the invention it is achieved that the image signal corresponding to the next image becomes available without it being necessary to pick up an image again after the reading of the preceding electronic image from the image storage section of the image sensor.

These and other aspects of the invention will be apparent from and elucidated with reference to the embodiments described hereinafter.

DESCRIPTION OF THE PREFERRED EMBODIMENTS

Figure 1:
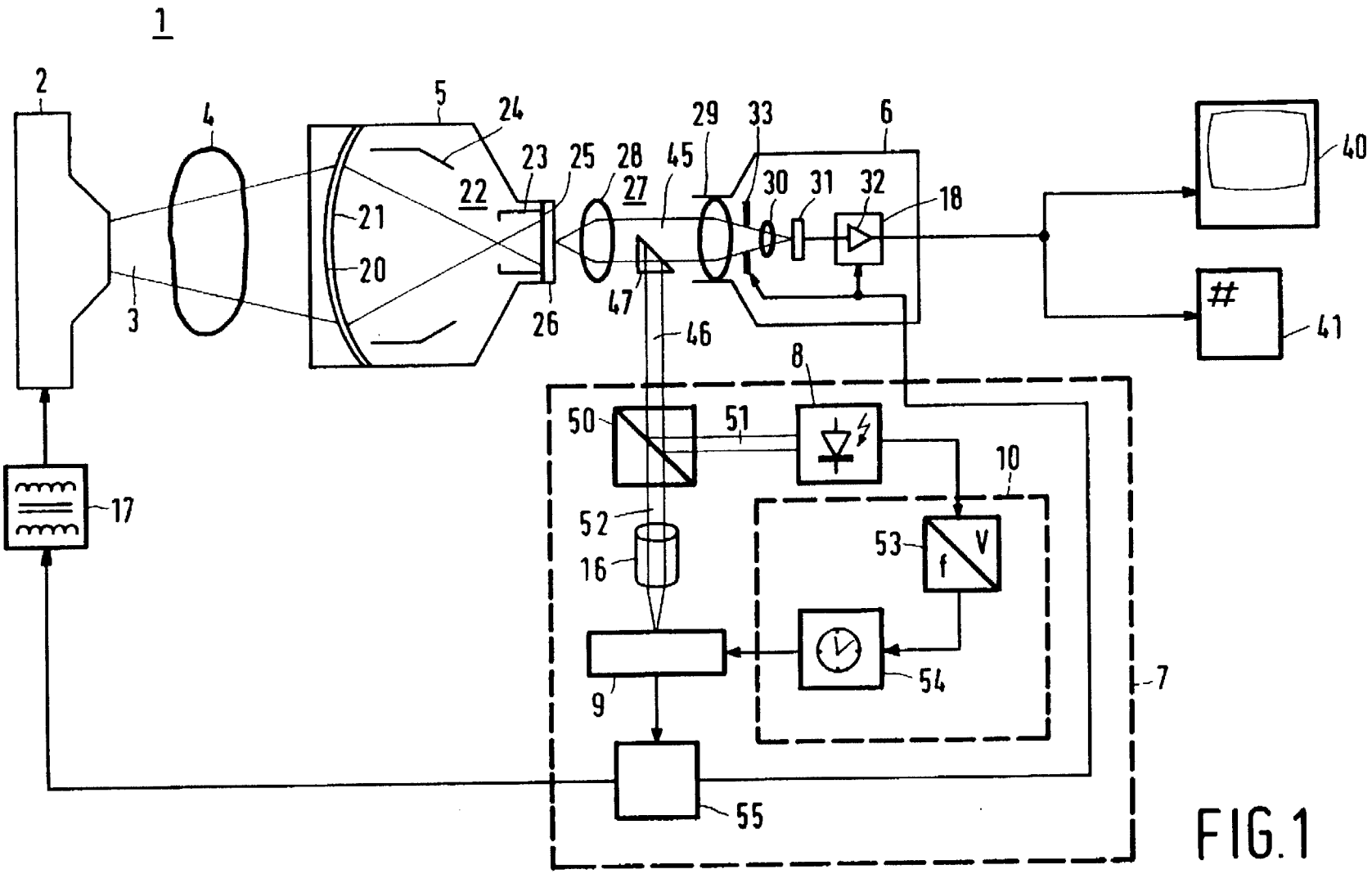
FIG. 1 is a diagrammatic representation of an X-ray examination apparatus in accordance with the invention.

FIG. 1 is a diagrammatic representation of an X-ray examination apparatus in accordance with the invention. The X-ray examination apparatus 1 comprises an X-ray source 2 which emits an X-ray beam 3 for irradiating an object, for example a patient to be radiologically examined. The X-ray detector of the present embodiment is formed by an X-ray image intensifier 5 which intercepts X-rays having traversed the object. An X-ray image is formed on an entrance screen 20 of the X-ray image intensifier 5 because of local differences in X-ray absorption in the object 4. The entrance screen 20 comprises a photocathode 21 which converts incident X-rays into an electron beam. Using an electron-optical system 22, comprising the photocathode 21, a hollow anode 23 and focusing electrodes 24, the electron beam is imaged on a phosphor layer 25. The phosphor layer 25 is provided on an exit window 26. The incident electrons form the optical image on the phosphor layer 25. The phosphor layer 25 converts incident electrons into visible light or infrared or ultraviolet radiation.

The exit window 26 is coupled to the image pick-up apparatus 6 by way of an optical system 27 which comprises a pair of lenses 28, 29. One of the lenses is the camera lens 29. The image pick-up apparatus is, for example a CCD video camera. The light emanating from the exit window is imaged onto the CCD sensor 31 by the optical system and a lens 30. Between the camera lens 29 and the lens 30 there is arranged a diaphragm 33 having an adjustable aperture. The intensity of the light incident on the CCD sensor is controlled by way of the diaphragm aperture. The CCD sensor converts the optical image on the exit window into a primary image signal which is amplified by an internal amplifier 32 which supplies the electronic image signal on an output of the image pick-up apparatus 6. The electronic image signal is applied to a monitor 40 on which the image information of the X-ray image is displayed or is applied to an image processing unit 41 for further processing.

The X-ray examination apparatus 1 also comprises an exposure-control system 7 for controlling the brightness of regions of interest in the optical image and/or the signal level of the electronic image signal. It is thus achieved that anatomic structures of interest are displayed with a high diagnostic quality, i.e. that small details are clearly visible in the image displayed. A small beam 46, split off the parallel light beam 45 between the lenses 28 and 29, is applied to the exposure-control system by means of a splitting prism 47. Evidently, the splitting prism may be replaced by a partly transparent mirror. The exposure-control system comprises the photosensor 8, for example a photodiode. The split off beam is split into a first sub-beam 51 and a second sub-beam 52 by means of a beam splitter 50. The first sub-beam 51 is received by the photosensor 8 which applies a photosensor signal, representing the mean brightness in the optical image, to a V/f converter 53. The V/f converter 53 converts the photosensor signal into a digital sensitivity control signal of a frequency proportional to the signal amplitude of the photosensor signal. The V/f converter 53 applies the digital signal to a timer unit 54 which controls the integration time of the photodetector 9 on the basis of the digital sensitivity control signal. The sensitivity of the photodetector 9, preferably being a CCD image sensor, can be controlled on the basis of the integration time during which the photodetector converts incident light into electric charge.

The second sub-beam 52 is sharply imaged onto (a part of) the photosensitive surface of the photodetector 9 by means of a gradient index lens 16. For example, the optical image is imaged onto a comparatively small part comprising 32×32 or 64×64 pixels. Consequently, the photodetector signal contains image information representing the comparatively coarse structures in the optical image. A control signal is derived from the photodetector signal by means of a signal processing unit 55. In order to control the energy and the intensity of the X-ray source 2, the control signal is applied to the high-voltage supply 17 of the X-ray source 2 by the signal processing unit 55. The energy and the intensity of the X-ray beam 3 are adjusted on the basis of said control signal in such a manner that a region of interest (ROI) in the optical image has a brightness and contrast such that the image information in said region of interest is displayed with a high diagnostic quality, for example on the monitor 40. The adjusting unit 18 or the diaphragm aperture of the image pick-up apparatus is controlled on the basis of the control signal supplied by the signal processing unit 55. As a result, the brightness of the ROI in the optical image and/or the diaphragm is adjusted so that the intensity of the light incident on the image sensor is accurately within the dynamic range of the image pick-up apparatus. It is thus avoided that image information is mutilated or lost during the formation of the electronic image signal. If necessary, the adjusting unit is also used to adjust the amplification of the electronic image signal, on the basis of the control signal, in such a manner that the image information in said region of interest is displayed with a high diagnostic quality.

Figure 2:
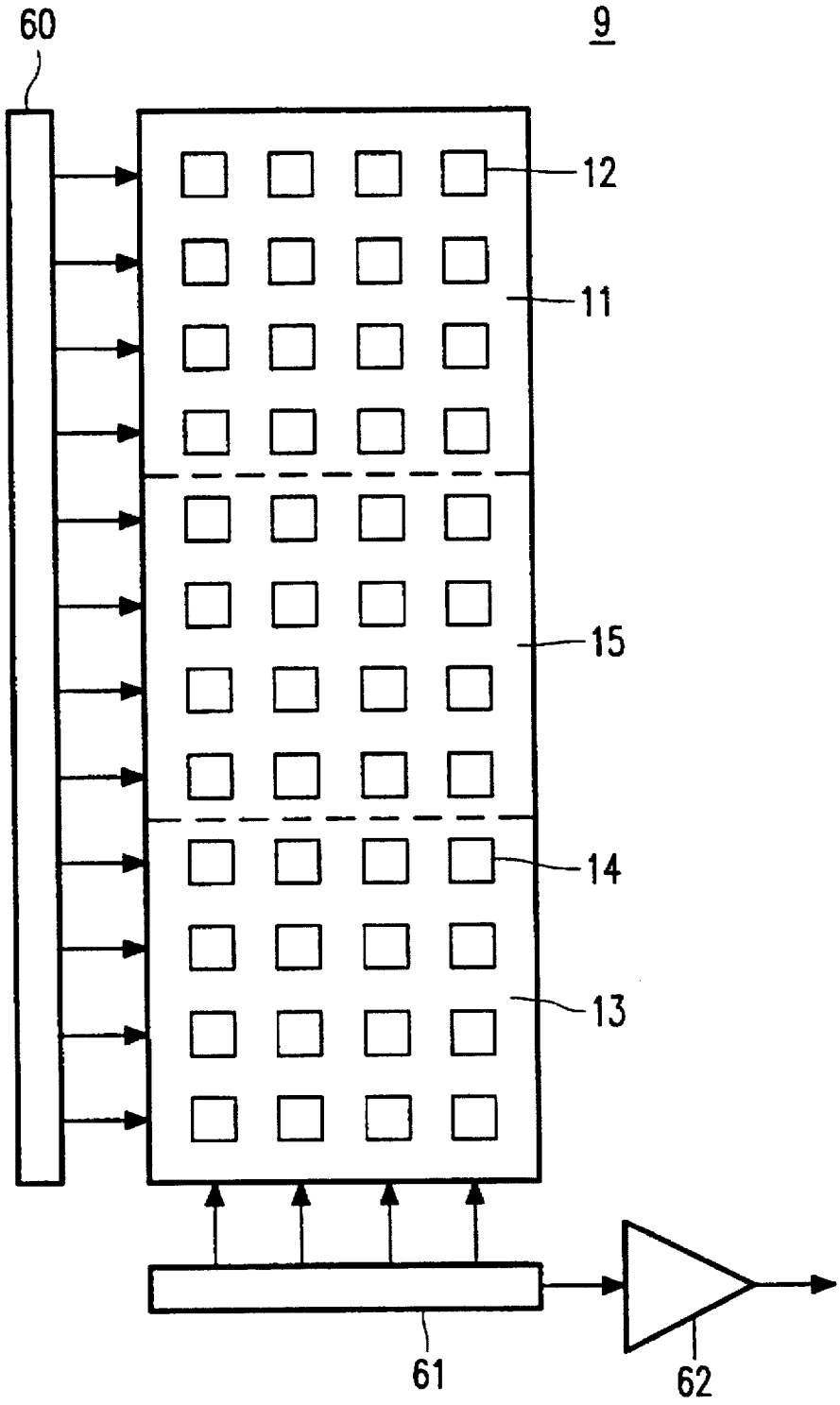
FIG. 2 is a diagrammatic representation of a first embodiment of the photodetector of the exposure-control system of the X-ray examination apparatus shown in FIG. 1.

FIG. 2 is a diagrammatic representation of a first embodiment of the photodetector 9 of the exposure-control system 7 of the X-ray examination apparatus 1 shown in FIG. 1. The photodetector is a charge-coupled photosensitive device which comprises an image pick-up section 11 with a multitude of photosensitive elements 12. For the sake of simplicity the Figure shows 4×4 photosensitive elements in the image pick-up section, but in practice photodetectors are used with an image pick-up section comprising as many as 512×512 or 350×300 photosensitive elements. Incident light, such as visible light or infrared or ultraviolet radiation, releases charge carriers in the semiconductor material of the photodetector, which charge carriers are collected underneath gate contacts of respective photosensitive elements. If the voltages on the gate contacts are varied according to an appropriate pattern by means of a row driver 60, the collected charge carriers, and hence the electronic image formed by said charge carriers, are transported in the direction of a read-out register 62. As soon as the integration time of the image pick-up section has elapsed, the electronic image is transferred to an intermediate memory 15. This intermediate memory is shielded from incident light, but for the remainder has the same construction as the image pick-up section. Because the electronic image is transferred from the image pick-up section to the intermediate memory by charge-coupled transfer of the charges, for said transfer of the electronic image takes only little time. For example, the transfer time $\tau_s$ for transferring an electronic image comprising 300 image lines amounts to only 46 μs; even much less time, approximately 5 μs, is required for the transfer of a small image of 32×32 pixels to the intermediate memory. Approximately the same amount of time is required for the charge-coupled transfer of the electronic image from the intermediate memory 15 to the image memory 13. Like the intermediate memory 15, the image memory 13 comprises a multitude of storage elements 14. Like the intermediate memory 15, the image memory 13 is also shielded from incident light. For example, the intermediate memory and the image memory may be covered by means of a layer of aluminium for this purpose. After the electronic image has been stored in the image memory 13, the charges are transferred to a read-out register 61 which forms an electronic signal which is convened, by an amplifier 62, into the primary image signal which is further amplified by the internal amplifier 32 of the image pick-up apparatus 6. In comparison with the amount of time required for the charge-coupled transfer, a comparatively long read-out time $\tau_r$ of approximately 200 μs is required to read out an image comprising 32×32 pixels. Such read-out times are known per se from European Patent Application EP 0 644 712, which corresponds to U.S. Pat. No. 5,530,935. When an electronic image has been read, a next electronic image can be read practically immediately, because the transfer from the intermediate memory to the image memory requires substantially less time ($\tau_s<\tau_r$) than the reading out of the image. In accordance with the invention it is notably ensured that if the picking up of an image is stopped briefly before completion of reading out of a previous image, it will not be necessary to pick up a new image after the image memory has been vacated. During the reading out of the previous electronic image from the image memory, an electronic image stored in the image pick-up section is transferred to the intermediate memory. As soon as the previous electronic image has been read out, the electronic image in the intermediate memory is transferred to the image memory and is read out; the intermediate memory is then available again for the storage of a next electronic image from the image pick-up section. Therefore, the photodetector in accordance with the invention may have an image rate amounting to approximately $1/\tau_r$, i.e. 5000 images per second. As a result, an X-ray examination apparatus in accordance with the invention can very quickly adapt the setting to changes in the optical image on the exit window of the X-ray image intensifier. For example, in the case of a shift of a region of interest in the optical image due to motion in or of the patient, the setting of the X-ray examination apparatus is quickly adapted so as to continue the display of said region of interest with a high diagnostic quality.

Figure 3:
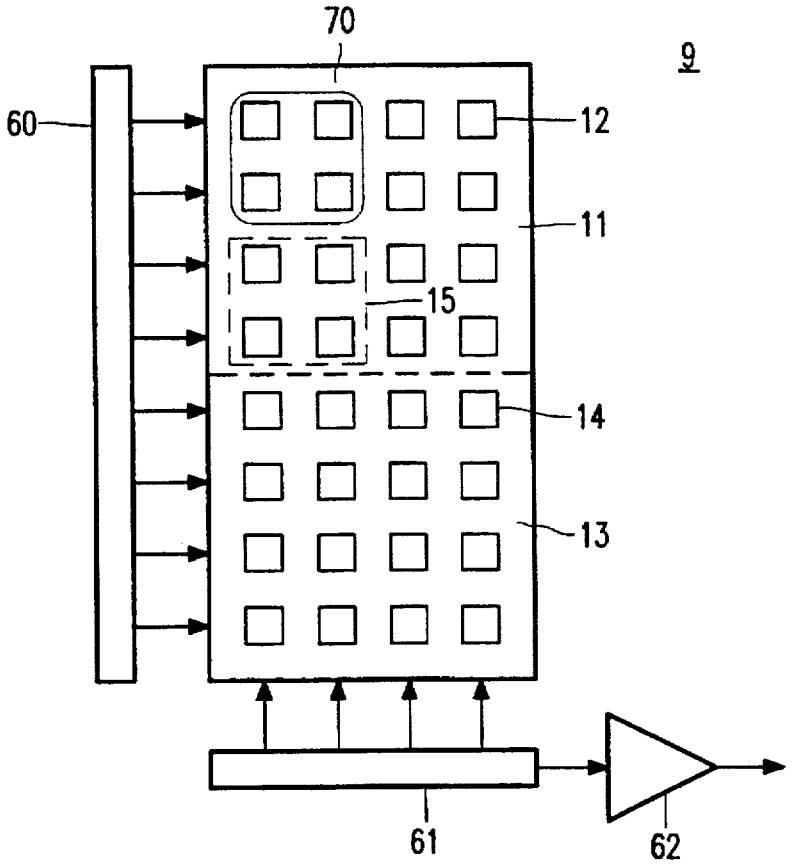
FIG. 3 is a diagrammatic representation of a second embodiment of the photodetector of the exposure-control system of the X-ray examination apparatus shown in FIG. 1.

FIG. 3 is a diagrammatic representation of a second embodiment of the photodetector of the exposure-control system of the X-ray examination apparatus shown in FIG. 1. The photodetector 9 of FIG. 3 comprises an intermediate memory 15 which forms part of the image pick-up section 11. Only a part 70 of the image pick-up section 11 is exposed. For the sake of simplicity, FIG. 3 shows an exposed area comprising only 2×2 elements 12, but in practice a region comprising 32×32 or 64×64 elements is preferably exposed. The number of elements exposed is much smaller than the total number of elements of the image pick-up section 11 (for example, 512×512 or 300×350). A GRIN lens, having a short focal distance of, for example one millimeter and a high numerical aperture of from approximately 0.3 to 0.5, can be advantageously used to make light incident substantially exclusively on elements in the exposed part. The elements outside the exposed part are not exposed so that they can be used as the intermediate memory 15.

Figure 4:
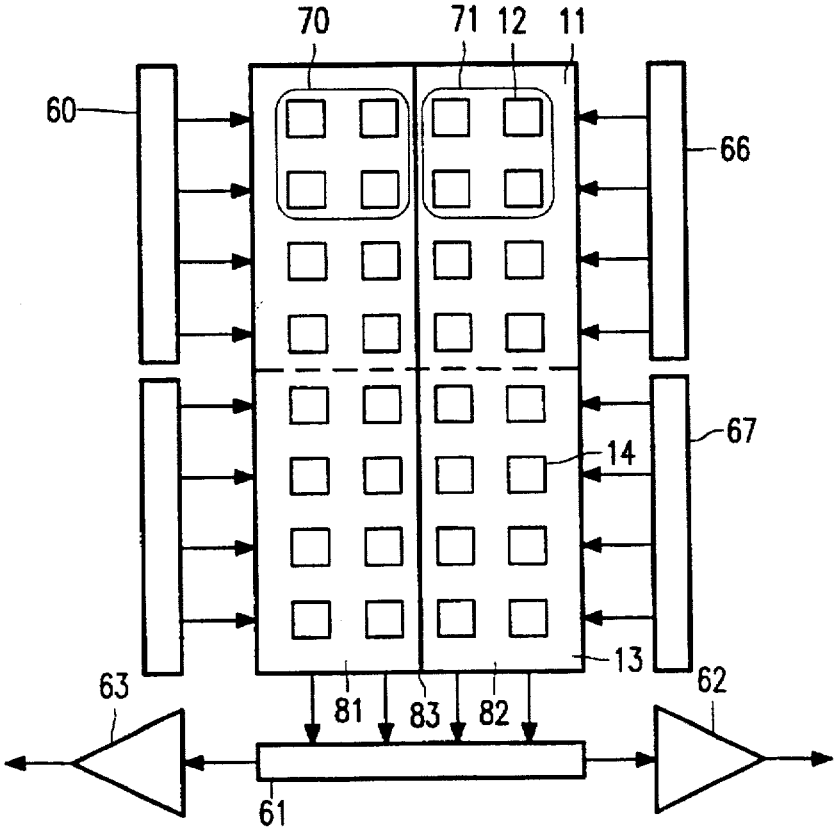
FIG. 4 is a diagrammatic representation of a third embodiment of the photodetector of the exposure-control system of the X-ray examination apparatus shown in FIG. 1.

FIG. 4 is a diagrammatic representation of a third embodiment of the photodetector of the exposure-control system of the X-ray examination apparatus shown in FIG. 1. The image memory 13 comprises two separate memory sections 81, 82 which are separated from one another by a barrier 83. The optical system is arranged so that the image picked up is imaged simultaneously onto two parts 70 and 71 of the image pick-up section. For example, two GRIN lenses are used for this purpose. The photodetector comprises a plurality of row drivers 64, 65, 66 and 67 whereby electronic images formed in the separate parts of the image pick-up section can be independently transferred to the separate memory sections. If a previous electronic image is still being read out from one of the memory sections, the electronic image can be transferred from one of the parts of the image pick-up section to the other image memory section while the reading out of the first memory section continues. Preferably, the pans of the image memory which are exposed by means of the optical system are chosen so that the images picked up are transferred to the relevant memory section by transporting electric charges along columns. In order to read out an electronic image signal, the charges are transferred from the relevant memory section 81 or 82 to a read-out register 61 which forms an electronic signal which is converted into the primary image signal by means of an amplifier 62, which primary image signal is further amplified by the internal amplifier 32 of the image pick-up apparatus 6. If desired, the photodetector may comprise a second amplifier 63. Electronic images from respective memory sections can then be converted into primary electronic image signals by means of respective amplifiers 62 and 63. By coupling separate (two or more) amplifiers to the read-out register for each memory section, the separate memory sections can be read out partly simultaneously, so that at least one memory section is made available faster for a next electronic image. Instead of using a photodetector comprising two sections which are separated by a barrier, use can alternatively be made of two separate photodetectors, for example two CCD sensors, on which the same image is picked up (substantially) simultaneously 1.

We claim:

1. An X-ray examination apparatus, comprising;

an X-ray detector for converting an X-ray image into an optical image, and an exposure-control system comprising a photodetector) for measuring brightness values of the optical image, which photodetector comprises:

an image pick-up section and an image storage section characterized in that the image storage section includes a first storage section and a second storage section and is arranged to receive brightness values in the first storage section, while brightness values are being read from the second storage section (15).

2. An X-ray examination apparatus as claimed in claim 1, characterized in that the first storage section constitutes an image memory, and that the second storage section is constructed as an intermediate memory which is coupled to the image pick-up section and to the image memory.

3. An X-ray examination apparatus as claimed in claim 2, characterized in that the image pick-up section is charge-coupled to the intermediate memory.

4. An X-ray examination apparatus as claimed in claim 2, characterized in that the intermediate memory is charge-coupled to the image memory.

5. An X-ray examination apparatus as claimed in claim 2, characterized in that the intermediate memory forms part of the image pick-up section.

6. An X-ray examination apparatus as claimed in claim 1, characterized in that the exposure-control system comprises an optical system for imaging at least a part of the optical image on no more than a part of the image pick-up section.

7. An X-ray examination apparatus as claimed in claim 6, characterized in that the optical system comprises a gradient index (GRIN) lens.

8. An X-ray examination apparatus as claimed in claim 1, characterized in that the exposure-control system is arranged to apply the control signal to the X-ray source or to the high-voltage power supply of the X-ray source.

9. An X-ray examination apparatus as claimed in claim 1, characterized in that the exposure-control system is arranged to apply the control signal to a control unit or to a diaphragm of the image pick-up apparatus.

10. An X-ray examination apparatus, comprising:

an X-ray detector for converting an X-ray image into an optical image, an image pick-up apparatus, comprising:

an image sensor for deriving an image signal from the optical image, which image sensor comprises an image pick-up section and an image storage section, characterized in that the image storage section includes a first storage section and a second storage section and is arranged to receive brightness values in the first storage section, while brightness values are being read from the second storage section, and that the first storage section constitutes an image memory, and the second storage section is constructed as an intermediate memory which is coupled to the image pick-up section and to the image memory.

11. An X-ray examination apparatus as claimed in claim 3, characterized in that the intermediate memory is charge-coupled to the image memory.

12. An X-ray examination apparatus as claimed in claim 3, characterized in that the intermediate memory forms part of the image pick-up section.

13. An X-ray examination apparatus as claimed in claim 4, characterized in that the intermediate memory forms part of the image pick-up section.

14. An X-ray examination apparatus as claimed in claim 11, characterized in that the intermediate memory forms part of the image pick-up section.

15. An X-ray examination apparatus as claimed in claim 5, characterized in that the exposure-control system comprises an optical system for imaging at least a part of the optical image on no more than a part of the image pick-up section.

16. An X-ray examination apparatus as claimed in claim 12, characterized in that the exposure-control system comprises an optical system for imaging at least a part of the optical image on no more than a part of the image pick-up section.

17. An X-ray examination apparatus as claimed in claim 13, characterized in that the exposure-control system comprises an optical system for imaging at least a part of the optical image on no more than a part of the image pick-up section.

18. An X-ray examination apparatus as claimed in claim 14, characterized in that the exposure-control system comprises an optical system for imaging at least a part of the optical image on no more than a part of the image pick-up section.

19. An X-ray examination apparatus as claimed in claim 15, characterized in that the optical system comprises a gradient index (GRIN) lens.

20. An X-ray examination apparatus as claimed in claim 16, characterized in that the optical system comprises a gradient index (GRIN) lens.

* * * * *